US006933915B2

(12) United States Patent
Hidaka et al.

(10) Patent No.: US 6,933,915 B2
(45) Date of Patent: Aug. 23, 2005

(54) SEMICONDUCTOR DEVICE FOR DRIVING LIQUID CRYSTAL AND LIQUID CRYSTAL DISPLAY APPARATUS

(75) Inventors: Kiyoshi Hidaka, Yokohama (JP); Takeshi Suyama, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 672 days.

(21) Appl. No.: 09/892,697

(22) Filed: Jun. 28, 2001

(65) Prior Publication Data

US 2002/0003518 A1 Jan. 10, 2002

(30) Foreign Application Priority Data

Jun. 29, 2000 (JP) ..... 2000-195940

(51) Int. Cl.[7] ..... G09G 3/36

(52) U.S. Cl. ..... 345/98; 345/531; 345/99; 345/100

(58) Field of Search ..... 345/530–531, 345/534–535, 547, 556, 87, 98–100; 710/57; 711/158

(56) References Cited

U.S. PATENT DOCUMENTS

| | | | | |
|---|---|---|---|---|
| 5,339,160 A | | 8/1994 | Shindou | 348/571 |
| 5,526,025 A | * | 6/1996 | Selwan et al. | 345/556 |
| 5,673,416 A | * | 9/1997 | Chee et al. | 345/535 |
| 5,864,512 A | | 1/1999 | Buckelew et al. | 365/230.01 |
| 6,119,207 A | * | 9/2000 | Chee | 711/158 |
| 6,145,033 A | * | 11/2000 | Chee | 710/57 |
| 6,333,745 B1 | * | 12/2001 | Shimomura et al. | 345/535 |

FOREIGN PATENT DOCUMENTS

| | | |
|---|---|---|
| JP | 63-234319 | 9/1988 |
| JP | 5-303361 | 11/1993 |
| JP | 10-105505 | 4/1998 |
| JP | 2000-122630 | 4/2000 |

* cited by examiner

*Primary Examiner*—Amr A. Awad
(74) *Attorney, Agent, or Firm*—Oblon, Spivak, McClelland, Maier & Neustadt, P.C.

(57) ABSTRACT

A small chip size and high picture quality, and also a quick CPU access operation to memory are achieved for a semiconductor device for driving liquid crystals. The semiconductor device includes a single-port memory that stores display-data to be displayed on a liquid crystal displaying section, a liquid crystal driver that retrieves the display-data stored in the single-port memory on a specific cycle and sends the display-data to the liquid crystal displaying section and a controller that controls the liquid crystal driver so that, when a CPU does not have access to the single-port memory, the display-data is retrieved from the single-port memory to the liquid crystal driver on the specific cycle and the retrieved data is sent to the liquid crystal displaying section, whereas, when the CPU has access to the single-port memory while the data is being retrieved from the single-port memory to the liquid crystal driver, a priority is given to the CPU so that the CPU starts an access operation while the liquid crystal driver stops a display-data retrieval operation, and on completion of the access operation, the liquid crystal driver starts again the display-data retrieval operation.

18 Claims, 6 Drawing Sheets

R-S FLIP-FLOP

SEMICONDUCTOR DEVICE FOR DRIVING LIQUID CRYSTAL AND LIQUID CRYSTAL DISPLAY APPARATUS

CROSS REFERENCE TO RELATED APPLICATIONS

This application claims benefit of priority under 35USC § 119 to Japanese Patent Application No. 2000-195940 filed on Jun. 29, 2000 in Japan, the entire contents of which are incorporated by reference herein.

BACKGROUND OF THE INVENTION

1. Field of the Invention

The present invention relates to a semiconductor device for driving liquid crystals, that installs a memory for storing display-data such as data to be displayed and to a liquid crystal display apparatus.

2. Discussion of the Background

Liquid crystal display apparatuses have been drawing the attention for being used as light-weight and lower-power consuming flat displays.

Shown in FIG. 5 is a block diagram of a liquid-crystal display apparatus that installs a RAM (Random Access Memory) as a display-data memory.

The liquid crystal display apparatus is provided with a liquid crystal displaying section 2, a common-electrode driver 40, a segment-electrode driver 45 and a display-data RAM 50.

The liquid crystal displaying section 2 is a simple matrix type equipped with a first transparent substrate on which common electrodes are arranged in parallel and a second transparent substrate on which segment electrodes are arranged in parallel.

The first and the second transparent substrates face each other so that the segment and common electrodes cross each other, with a liquid crystal layer interposed therebetween.

A scanning line COMi (i=1, . . . , m) is connected to each common electrode. Moreover, a signal line SEGj (j=1, . . . , n) is connected to each segment electrode.

One of the scanning lines is selected by the common-electrode driver 40 to drive a common electrode connected to the selected scanning line.

Data to be displayed stored in the display-data RAM 50 are retrieved by the segment-electrode driver 45 and supplied to the corresponding segment electrodes via the signal lines.

The segment-electrode driver 45 and the display-data RAM 50 are fabricated on one chip, which is called a liquid crystal-driving semiconductor device.

A known liquid crystal-driving semiconductor device is shown in FIG. 6. The known device is provided with the segment-electrode driver 45 and the display-data RAM 50.

The display-data RAM 50 is provided with a cell array 51 on which RAM cells 52 are arranged in a matrix, an address decoder 55, a display-data read counter/decoder 57, an I/F (interface) controller 60, a data I/O circuit 62 and an oscillator 65. Each RAM cell 52 consists of two transistors, a latch circuit having two inverter gates, and a three-state driver.

The display-data RAM 50 shown in FIG. 6 is therefore a dual-port RAM 50 in which each RAM cell 52 has ten transistors.

When a CPU (not shown) has access to the display-data RAM 50, it sends an I/F signal to the I/F controller 60. On receiving the signal, the I/F controller 60 drives the address decoder 55 and the data I/O circuit 62.

An address decided by the CPU is input to the address decoder 55 via an address bus and decoded, so that the corresponding RAM cell 52 is selected on the display-data RAM 50.

Data programming is performed such that data sent on the data bus is programmed into the selected cell on the display-data RAM 50 via the data I/O circuit 62.

Data retrieval is performed such that data is retrieved from the selected cell on the RAM 50 and sent to the data bus via the data I/O circuit 62.

Data transfer to the liquid crystal displaying section 2 is performed such that the oscillator 65 sends a clock signal to the display-data read counter/decoder 57. On receiving the clock signal, the counter/decoder 57 sends a selection signal to the RAM 50. Data is then retrieved from the corresponding RAM cell 52 and stored in the segment driver 45 in response to a latch signal output by the counter/decoder 57.

The known liquid crystal-driving semiconductor device shown in FIG. 6 has a display-data output port and a CPU-access input/output port separately, so that the CPU can have an asynchronous access to the RAM 50.

The known device however requires ten transistors for each RAM 52 because the display-data RAM is a dual-port RAM, thus becoming large in its chip size.

FIG. 7 shows another known liquid crystal-driving semiconductor device for which the chip-size problem has been solved.

The known device shown in FIG. 7 is provided with a display-data RAM 50A of the same type as the display-data RAM 50 (FIG. 6) except that the RAM 50A has two transistors and two inverter gates for each RAM cell 53. The display-data RAM 50A is therefore a single-port RAM 50A. The known device in FIG. 7 is also provided with a segment-electrode driver 46.

Each memory cell 53 has six transistors, so that the chip size for the single-port RAM 50A is smaller than the known liquid crystal-driving semiconductor device shown in FIG. 6.

In the known liquid crystal-driving semiconductor device shown in FIG. 7, however, the RAM 50A has a single port that is used as a display-data output port and also as a CPU-access input/output port, so that a CPU can not have an asynchronous access to the RAM 50A.

When a CPU (not shown) tries to have access while the liquid crystal displaying section is to retrieve data from the RAM 50A, either the CPU or the displaying section has the priority whereas the other has to wait.

The liquid crystal displaying section retrieves data on a constant cycle. When the CPU has the priority, it programs data on the RAM 50A while this data has remained in the CPU-access input/output port that is the display-data output port.

This results in that, when the liquid crystal displaying section retrieves display-data from the RAM 50A, the data that has been programmed by the CPU is retrieved as the display-data. This data is different from the data to be displayed and also has no correlation with data now on display. And, if displayed, this data causes flicker on screen, thus degrading picture quality.

On the other hand, when the liquid crystal display has the priority, the CPU takes long for data programming to the RAM 50A.

SUMMARY OF THE INVENTION

A purpose of the present invention is to provide a liquid crystal-driving semiconductor device and a liquid crystal display apparatus fabricated on a small chip on which a CPU has a quick access to memory with high picture quality.

A semiconductor device for driving liquid crystals according to the present invention includes: a single-port memory that stores display-data to be displayed on a liquid crystal displaying section; a liquid crystal driver that retrieves the display-data stored in the single-port memory on a specific cycle and sends the display-data to the liquid crystal displaying section; and a controller that controls the liquid crystal driver so that, when a CPU does not have access to the single-port memory, the display-data is retrieved from the single-port memory to the liquid crystal driver on the specific cycle and the retrieved data is sent to the liquid crystal displaying section, whereas, when the CPU has access to the single-port memory while the data is being retrieved from the single-port memory to the liquid crystal driver, a priority is given to the CPU so that the CPU starts an access operation while the liquid crystal driver stops a display-data retrieval operation, and on completion of the access operation, the liquid crystal driver starts again the display-data retrieval operation.

In the semiconductor device for driving liquid crystals according to the present invention, the controller controls the liquid crystal driver so that a priority is given to the CPU to start an access operation, and on completion of the access operation, the liquid crystal driver starts again the display-data retrieval operation.

This control operation achieves high picture quality and a quick memory access operation for the CPU.

The memory is the single-port memory and hence can be fabricated on a small chip.

Moreover, a semiconductor device for driving liquid crystals according to the present invention includes: a single-port memory that stores display-data to be displayed on a liquid crystal displaying section; a liquid crystal driver, having a latch for storing the display-data stored in the single-port memory, that retrieves the display-data from the single-port memory on a specific cycle and sends the display-data to the liquid crystal displaying section; and a controller that generates a latch control signal and sends the latch control signal to the latch, the latch control signal being generated based on a CPU-access signal indicating an access operation of a CPU to the single-port memory and a specific signal that is synchronized with a display-data retrieval cycle for the liquid crystal driver.

Furthermore, a liquid crystal display apparatus according to the present invention is provided with the semiconductor device for driving liquid crystals and a liquid crystal displaying section.

DETAILED DESCRIPTION OF PREFERRED EMBODIMENTS

Embodiments according to the present invention will be disclosed with reference to FIGS. 1 to 4.

Figure 1:
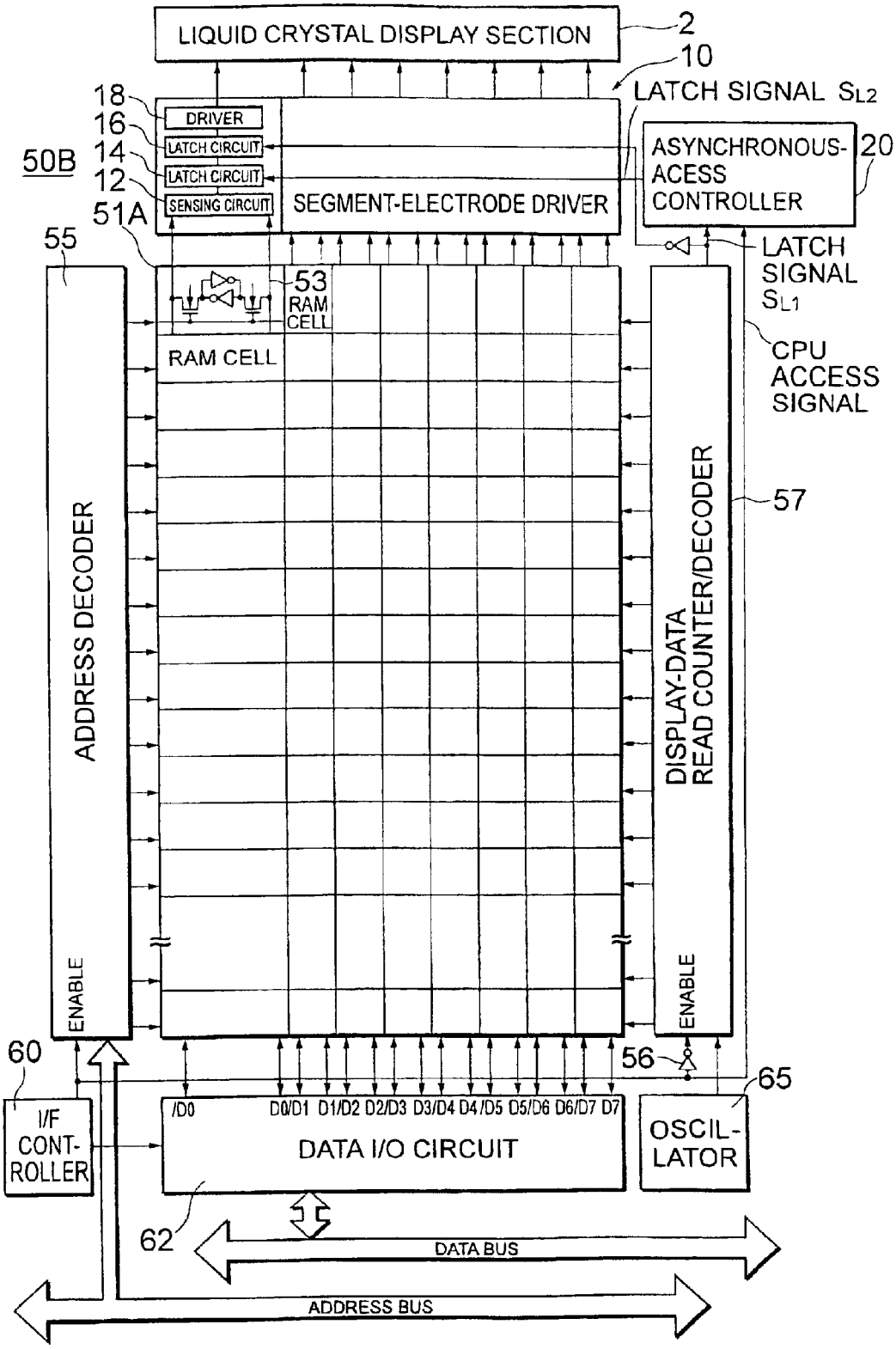
FIG. 1 shows a block diagram of an embodiment of a liquid crystal display apparatus according to the present invention.

FIG. 1 shows a block diagram of an embodiment of a liquid crystal display apparatus according to the present invention.

The liquid crystal display apparatus is provided with a liquid crystal displaying section 2 and a liquid crystal-driving semiconductor device. The semiconductor device includes a segment-electrode driver (also called a liquid crystal driver) 10, an asynchronous-access controller 20 and a display-data RAM 50B for storing data to be displayed (display-data), etc.

The display-data RAM 50B is provided with a cell array 51A on which RAM cells 53 are arranged in a matrix, an address decoder 55, an inverter gate 56, a display-data read counter/decoder 57, an I/F (interface) controller 60, a data I/O circuit 62 and an oscillator 65. The display-data RAM 50B is a single-port RAM in which each RAM cell 53 consists of two transistors and a latch circuit having two inverter gates.

The liquid crystal displaying section 2 is configured such that a first transparent substrate on which common electrodes are arranged in parallel and a second transparent substrate on which segment electrodes are arranged in parallel face each other so that the segment and common electrodes cross each other, with a liquid crystal layer interposed therebetween.

A scanning line is connected to each common electrode. A signal line is connected between each segment electrode and the corresponding output terminal of the segment-electrode driver 10.

Figure 5:
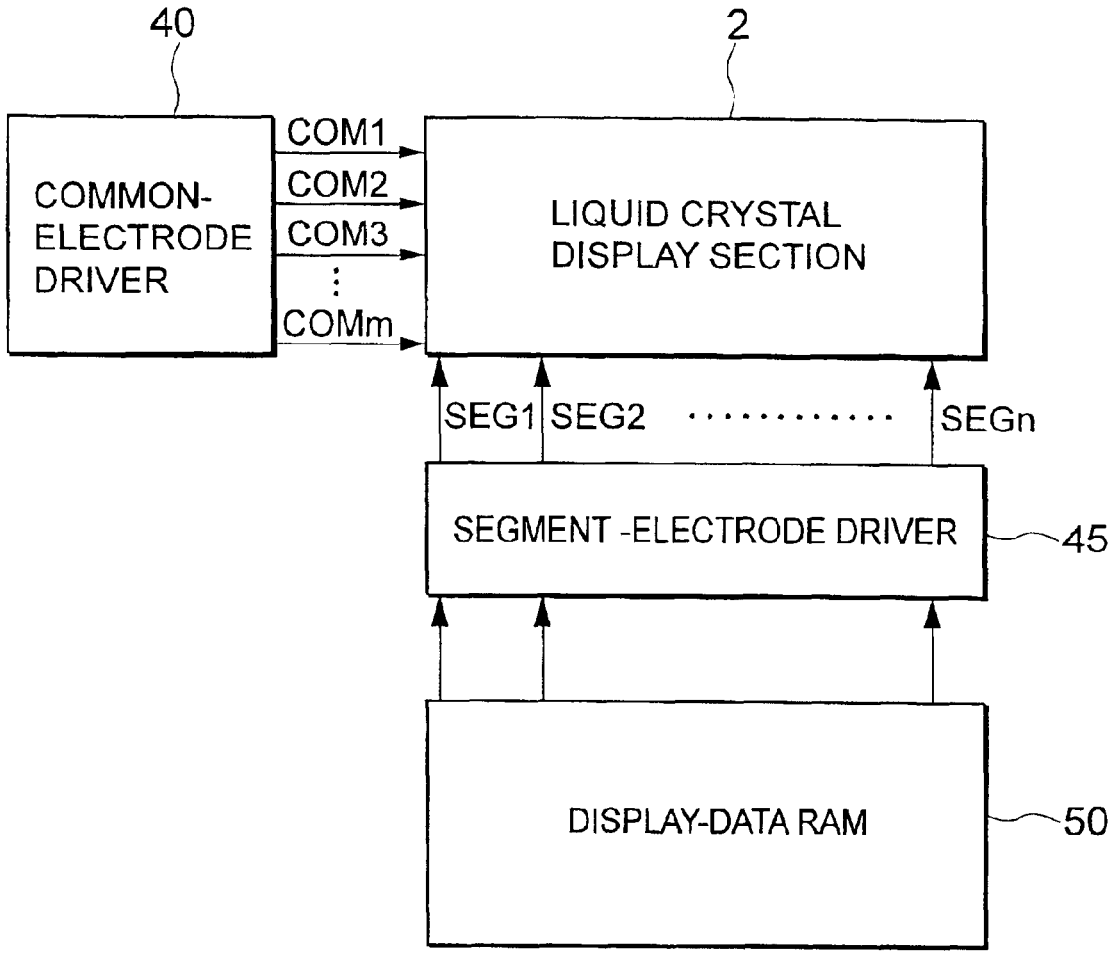
FIG. 5 shows a block diagram of a matrix liquid crystal display apparatus.
Figure 6:
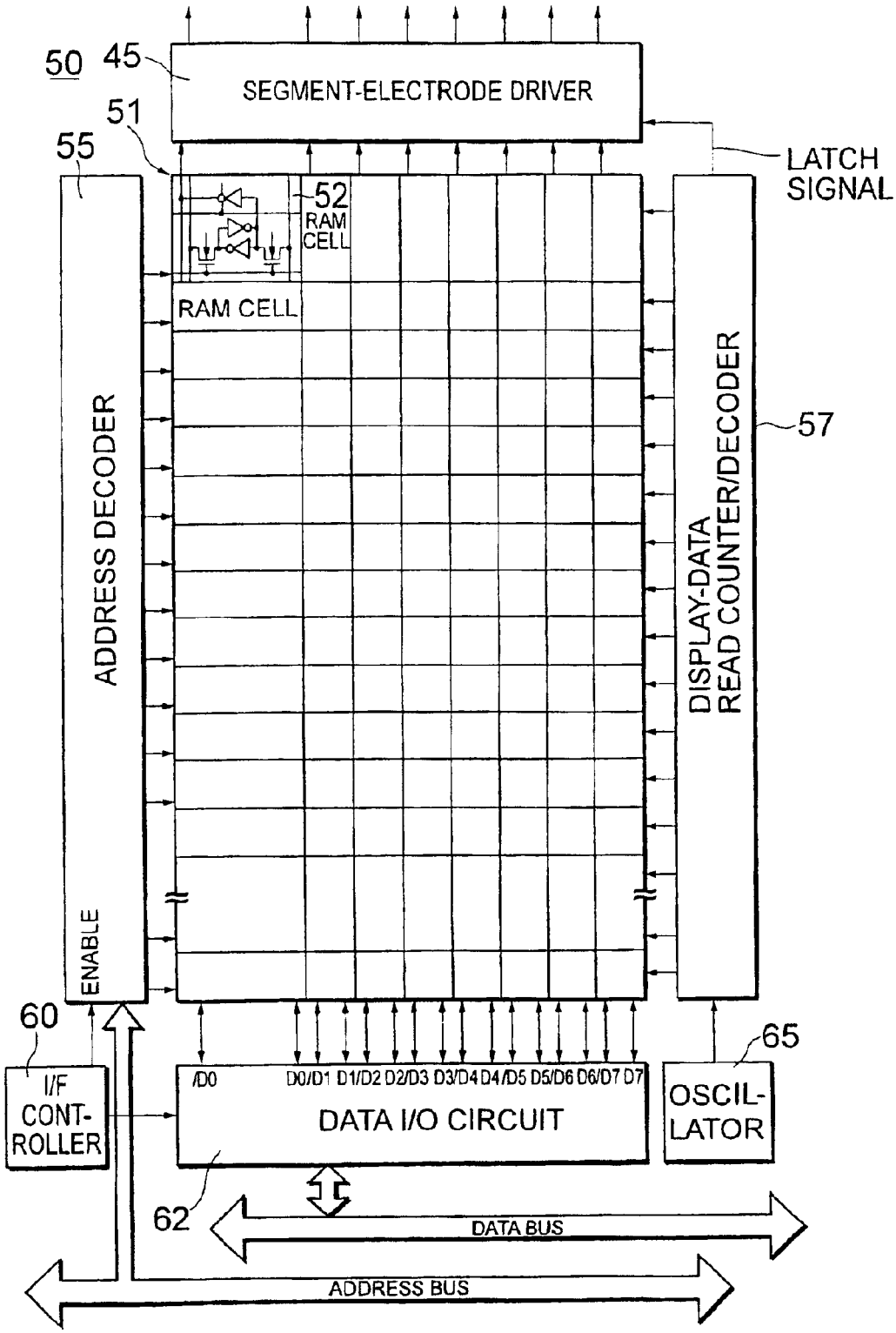
FIG. 6 shows a block diagram of a known liquid crystal-driving semiconductor device.
Figure 7:
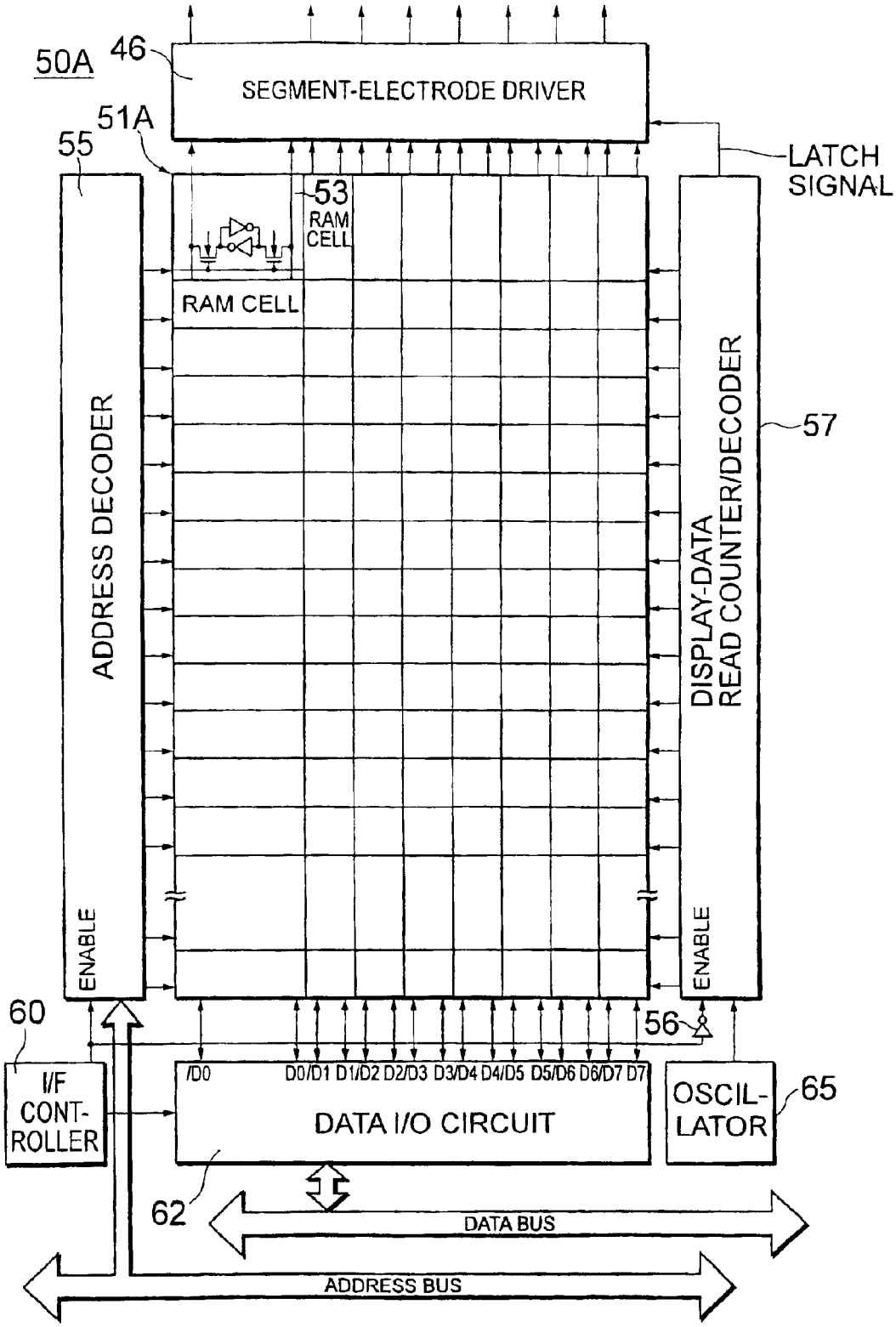
FIG. 7 shows a block diagram of another known liquid crystal-driving semiconductor device.

One of the scanning lines is selected by a common-electrode driver like the one shown in FIG. 5 to drive a common electrode.

The segment-electrode driver 10 is provided with a sensing circuit 12, latch circuits 14 and 16, and a driver 18 for each signal line.

The sensing circuit 12 senses data retrieved from the corresponding RAM cell 53. The latch circuit 14 stores the output of the sensing circuit 12 in response to a latch signal $S_{L2}$ sent from the asynchronous-access controller 20. The latch circuit 16 stores the output of the latch 14 in response to an inverted signal of a latch signal $S_{L1}$ sent from the display-data read counter/decoder 57. The driver 18 sends the output of the latch circuit 16 to the corresponding signal line.

Figure 2:
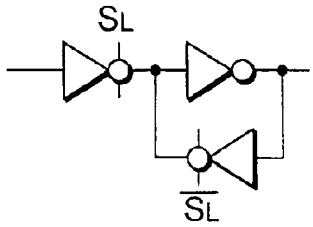
FIG. 2 shows a circuit diagram of a latch of a segment-electrode driver of the liquid crystal display apparatus.

The latch circuits 14 and 16 consist of two clocked-inverter gates and one inverter gate each, as shown in FIG. 2. Supplied to clock terminals of the clocked-inverter gates are a latch signal $S_{L1}$ and its inverted signal, respectively.

The asynchronous-access controller 20 generates the latch signal $S_{L2}$ based on a CPU-access signal sent from the I/F controller 60 and the latch signal $S_{L1}$ sent from the display-data read counter/decoder 57.

Disclosed next is an operation of the preferred embodiment according to the present invention.

When a CPU (not shown) has access to the display-data RAM 50B, it sends an I/F signal to the I/F controller 60. On receiving the signal, the I/F controller 60 activates the address decoder 55 and the data I/O circuit 62 and sends the CPU-access signal to the asynchronous-access controller 20. The CPU-access signal is also sent to the display-data read counter/decoder 57 via the inverter gate 56 to deactivate the counter/decoder 57.

An address decided by the CPU is input to the address decoder 55 via an address bus and decoded, so that the corresponding RAM cell 53 is selected on the display-data RAM 50B.

Data programming is performed such that data sent on the data bus is programmed into the selected RAM cell 53 on the display-data RAM 50B via the data I/O circuit 62.

Data retrieval is performed such that data is retrieved from the selected RAM cell 53 on the RAM 50B and sent to the data bus via the data I/O circuit 62.

When the CPU has no access to the display-data RAM 50B, in other words, data is sent to the liquid crystal displaying section 2 from the RAM 50B, the display-data read counter/decoder 57 is in an active state because no CPU-access signal is generated by the I/F controller 60.

On receiving a clock signal sent from the oscillator 65, the counter/decoder 57 sends a selection signal to the RAM 50B. Data is then retrieved from the corresponding RAM cell 53 and sent to the segment-electrode driver 10. The data retrieval is performed on a specific cycle by the driver 10.

The data retrieved and sent to the segment-electrode driver 10 is sensed by the sensing circuit 12 and stored in the latch circuit 14 in response to a latch signal $S_{L2}$ from the asynchronous-access controller 20.

The output of the latch circuit 14 is further stored in the latch circuit 16 in response to an inverted signal of a latch signal $S_{L1}$ from the display-data read counter/decoder 57. The output of the latch circuit 16 is sent to the corresponding signal line via the driver 18 and displayed on the liquid crystal displaying section 2.

Disclosed next is the asynchronous-access controller 20 before disclosure of, in what timing, the latch signal $S_{L2}$ is output by the controller 20.

Figure 3A:
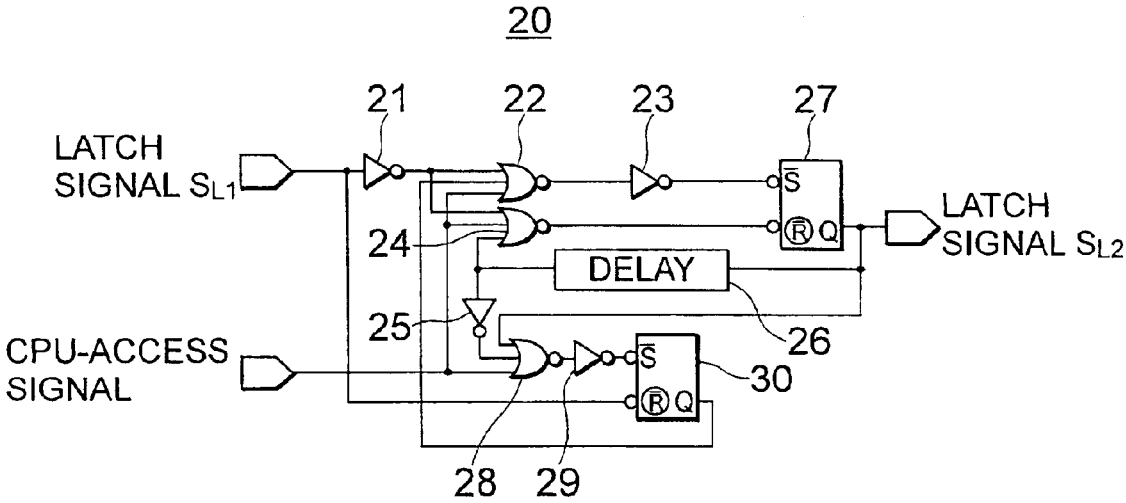
FIG. 3A shows a circuit diagram of an asynchronous-access controller of the liquid crystal display apparatus.

FIG. 3A shows a circuit block diagram of the asynchronous-access controller 20 used in the liquid crystal display apparatus.

The asynchronous-access controller 20 shown in FIG. 3A is provided with inverter gates 21, 23, 25 and 29, 3-input NOR gates 22, 24 and 28, a delay circuit 26 and R-S flip-flops 27 and 30.

The latch signal $S_{L1}$ is sent to the input terminal of the inverter gate 21 and also the reset terminal of the R-S flip-flop 30. The output of the inverter gate 21 is sent to one of the three input terminals of each of the NOR gates 22 and 24. The output of the NOR gate 22 is sent to the set terminal of the R-S flip-flop 27 via the inverter gate 23.

The CPU-access signal is sent to either of the remaining two input terminals of each of the NOR gates 22 and 24 and also one of the three input terminals of the NOR gate 28.

The output of the NOR gate 24 is sent to the reset terminal of the R-S flip-flop 27. The flip-flop 27 outputs the latch signal $S_{L2}$ which is further sent to the input terminal of the delay circuit 26 and either of the remaining two input terminals of the NOR gate 28.

The output of the delay circuit 26 is sent to the remaining one terminal of the NOR gate 24 and also the remaining one terminal of the NOR 28 via the inverter gate 25.

The output of the NOR gate 28 is sent to the set terminal of the R-S flip-flop 30 via the inverter gate 29. The output of the flip-flop 30 is sent to the remaining one terminal of the NOR gate 22.

Figure 3B:
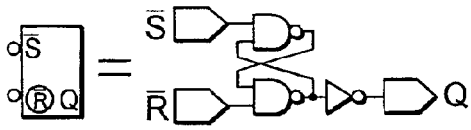
FIG. 3B shows a circuit diagram of an R-S flip-flop of the asynchronous-access controller shown in FIG. 3A.

Each of the R-S flip-flops 27 and 30 is provided with two NAND gates and one inverter gate, as shown in FIG. 3B.

Figure 4:
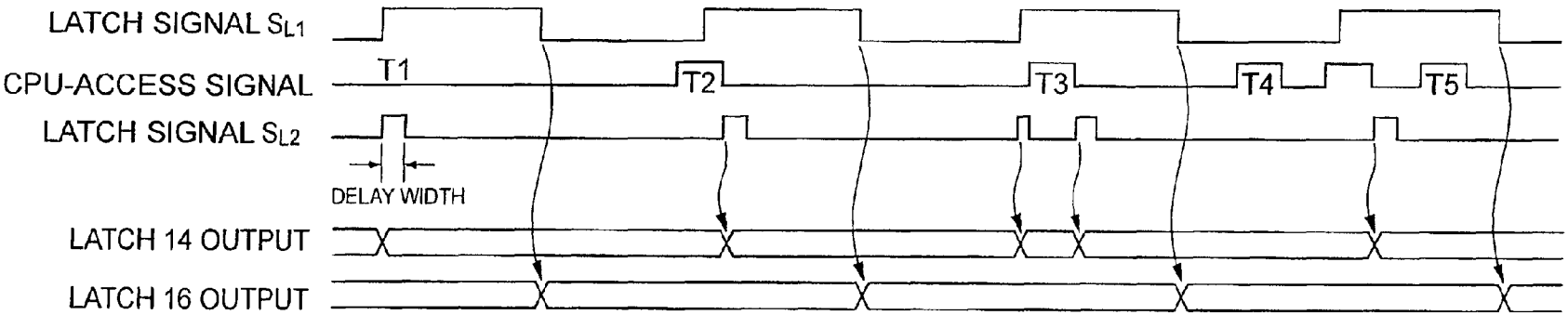
FIG. 4 shows a timing chart for indicating an operation of the asynchronous-access controller.

Disclosed next with reference to FIG. 4 is that, in what timing, the latch signal $S_{L2}$ is output by the asynchronous-access controller 20.

a) In timing T1, or when the CPU has no access to the display-data RAM 50B while the latch signal $S_{L1}$ is at "H" (a high level), the asynchronous-access controller 20 outputs a pulse signal for a period corresponding to a delay time of the delay circuit 26 as the latch signal $S_{L2}$ in synchronism with the rising moment of the latch signal $S_{L1}$. Data retrieved from a cell of the RAM 50B is stored in the latch circuit 14 via the sensing circuit 12. The delay time is decided according to a period of time required for data retrieval from a RAM cell 53.

The output of the latch circuit 14 is then stored in the latch circuit 16 when the latch signal $S_{L1}$ output by the display-data read counter/decoder 57 falls to "L" (a low level) in synchronism with a data-retrieval operation of the segment-electrode driver 10.

b) In timing T2, or when the latch signal $S_{L1}$ is raised to "HH" while the CPU is having access to the RAM 50B, since the CPU has a priority for access, the asynchronous-access controller 20 outputs a pulse signal as the latch signal $SL_2$ for a period corresponding to a delay time of the delay circuit 26 on completion of the access operation. Data retrieved from a RAM cell 53 is stored in the latch circuit 14 via the sensing circuit 12 in response to the latch signal $S_{L2}$. This data is further stored in the latch 16 when the latch signal $S_{L1}$ falls to "L".

c) In timing T3, when the CPU starts an access operation even though the latch signal $S_{L2}$ has been output in synchronism with the rising moment of the latch signal $S_{L1}$, the CPU has a priority, so that a data-latch operation is halted. On completion of accessing by the CPU, a pulse signal, or the latch signal $S_{L2}$ is output again for a period corresponding to a delay time for the delay circuit 26. Data retrieved from a RAM cell 53 is stored in the latch circuit 14 via the sensing circuit 12 in response to this latch signal $S_{L2}$. This data is further stored in the latch circuit 16 when the latch signal $S_{L1}$ falls to "L".

d) In timing T4, when the CPU starts an access operation while no data-latch operation has been performed, the access operation is only performed by the CPU whereas no latch signal $S_{L2}$ is output.

e) In timing T5, after the sequential operations in b), when the CPU starts again an access operation while the latch signal $S_{L1}$ is "H", the access operation is only performed with no latch signal $S_{L2}$ being output, even though it is the correct data-latch timing. This is because that a data-latch operation has already been successfully performed in b).

As disclosed above, according to the preferred embodiment, a single-port RAM is used as the built-in display-data RAM 50B. When the CPU starts an access operation while the liquid crystal displaying section 2 is retrieving display-data from the display-data RAM 50B, the CPU has a priority for the access operation. Then, on completion of the access operation, the display-data is retrieved again from the display-data RAM 50B and sent to the liquid crystal displaying section 2 (timing T3).

The present invention offers a small chip size and high picture quality. Moreover, a quick access operation is achieved by giving a priority to the CPU.

Display-data output by a RAM cell 53 is once stored in the latch circuit 14 in response to the latch signal $S_{L2}$ and then stored in the latch circuit 16 at the inverted signal of the latch signal $S_{L1}$. Display-data is thus always output to the liquid crystal displaying section 2 in synchronism with the falling edge of the latch signal $S_{L1}$. In other words, the output to the displaying section 2 is not dependent on data-latch timing by the latch signal $S_{L2}$ and hence a display on the liquid crystal display will not be affected by the data-latch timing.

A pulse width for the CPU-access signal wider than ((a pulse width for the latch signal $S_{L1}$)−(a delay time for the delay circuit)) do not allow the use of the asynchronous-access controller according to the preferred embodiment. This will, however, cause any particular problem because a pulse width for the CPU-access signal is usually much narrower than that for the latch signal $S_{L1}$.

The liquid crystal displaying section 2 may be of active matrix type instead of simple matrix type.

Moreover, DRAM (Dynamic Random Access Memory) can be used as the display-data RAM instead of SRAM (Static Random Access Memory) used in the preferred embodiment. Not only that, any other types of memory having memory cells aligned in a scanning direction from which display-data can be retrieved at once can be used instead of the display-data RAM.

As disclosed, the present invention offers a small chip size and high picture quality, and also achieves a quick memory access operation for CPU.

What is claimed is:

1. A semiconductor device for driving liquid crystals comprising:

a single-port memory that stores display-data to be displayed on a liquid crystal displaying section;

a liquid crystal driver that retrieves the display-data stored in the single-port memory on a specific cycle and sends the display-data to the liquid crystal displaying section; and a controller that controls the liquid crystal driver so that, when a CPU does not have access to the single-port memory, the display-data is retrieved from the single-port memory to the liquid crystal driver on the specific cycle and the retrieved data is sent to the liquid crystal displaying section, whereas, when the CPU has access to the single-port memory while the data is being retrieved from the single-port memory to the liquid crystal driver, a priority is given to the CPU so that the CPU starts an access operation while the liquid crystal driver stops a display-data retrieval operation, and on completion of the access operation, the liquid crystal driver starts again the display-data retrieval operation, wherein the liquid crystal driver includes:

a first latch circuit that stores the display-data from the single-port memory in response to a first latch signal; and a second latch circuit that stores an output of the first latch circuit in response to a second latch signal, and wherein the controller outputs the first latch signal based on the second latch signal and a CPU-access signal that indicates the access operation of the CPU to the single-port memory.

2. The semiconductor device for driving liquid crystals according to claim 1, wherein the controller controls the liquid crystal driver so that the liquid crystal driver stops the display-data retrieval operation when a display-data retrieval timing comes while the CPU is having access to the single-port memory, and on completion of the access operation, the liquid crystal driver starts the display-data retrieval operation.

3. The semiconductor device for driving liquid crystals according to claim 1, wherein the first and the second latch circuits are provided for each output port of the single-port memory.

4. The semiconductor device for driving liquid crystals according to claim 1, wherein the controller includes a delay circuit, and controls the liquid crystal driver so that, when the second latch signal is activated while the CPU does not have access to the single-port memory, a pulse signal is output as the first latch signal in synchronism with the activation of the second latch signal for a period corresponding to a delay time of the delay circuit, and then the output of the first latch circuit is stored in the second latch circuit when the second latch signal is deactivated.

5. The semiconductor device for driving liquid crystals according to claim 1, wherein the controller includes a delay circuit, and controls the liquid crystal driver so that, when the second latch signal is activated while the CPU is having access to the single-port memory, the access to the single-port memory is prioritized, a pulse signal is output as the first latch signal for a period corresponding to a delay time of the delay circuit on completion of the access operation, and then the output of the first latch circuit is stored in the second latch circuit when the second latch signal is deactivated.

6. The semiconductor device for driving liquid crystals according to claim 1, wherein the controller includes a delay circuit, and controls the liquid crystal driver so that, when the CPU starts to have access to the single-port memory while the first latch signal is being output in synchronism with activation of the second latch signal, the access to the single-port memory is prioritized while a latching operation of the first latch circuit is halted, a pulse signal is output again as the first latch signal for a period corresponding to a delay time of the delay circuit on completion of the access operation, and then the output of the first latch circuit is stored in the second latch circuit when the second latch signal is deactivated.

7. The semiconductor device for driving liquid crystals according to claim 1, wherein the controller includes a delay circuit, and controls the liquid crystal driver so that, when the CPU starts the access operation after a pulse signal has been output as the first latch signal for a period corresponding to a delay time of the delay circuit in response to activation of the second latch signal, while the second latch signal has still been activated, the access operation is performed whereas the first latch signal is not output again on completion of the access operation, and then the output of the first latch circuit is stored in the second latch circuit when the second latch signal is deactivated.

8. The semiconductor device for driving liquid crystals according to claim 1, wherein a pulse width for the CPU-access signal is narrower than a difference between a pulse width for the second latch signal and the delay time of the delay circuit.

9. A semiconductor device for driving liquid crystals comprising:

a single-port memory that stores display-data to be displayed on a liquid crystal displaying section;

a liquid crystal driver, including a first latch circuit that stores the display-data from the single-port memory in response to a first latch signal and a second latch circuit that stores an output of the first latch circuit in response to a second latch signal, that retrieves the display-data from the single-port memory on a specific cycle and sends the display-data to the liquid crystal displaying section; and a controller that generates the first latch signal and sends the first latch signal to the first latch circuit, the first latch signal being generated based on a CPU-access signal indicating an access operation of a CPU to the single-port memory and the second latch signal that is synchronized with a display-data retrieval cycle for the liquid crystal driver.

10. The semiconductor device for driving liquid crystals according to claim 9, wherein the first and the second latch circuits are provided for each output port of the single-port memory.

11. The semiconductor device for driving liquid crystals according to claim 9, wherein the controller includes a delay circuit, and controls the liquid crystal driver so that, when the second latch signal is activated while the CPU does not have access to the single-port memory, a pulse signal is output as the first latch signal in synchronism with the activation of the second latch signal for a period corresponding to a delay time of the delay circuit, and then the output of the first latch circuit is stored in the second latch circuit when the second latch signal is deactivated.

12. The semiconductor device for driving liquid crystals according to claim 9, wherein the controller includes a delay circuit, and controls the liquid crystal driver so that, when the second latch signal is activated while the CPU is having access to the single-port memory, the access to the single-port memory is prioritized, a pulse signal is output as the first latch signal for a period corresponding to a delay time of the delay circuit on completion of the access operation, and then the output of the first latch circuit is stored in the second latch circuit when the second latch signal is deactivated.

13. The semiconductor device for driving liquid crystals according to claim 9, wherein the controller includes a delay circuit, and controls the liquid crystal driver so that, when the CPU starts to have access to the single-port memory while the first latch signal is being output in synchronism with activation of the second latch signal, the access to the single-port memory is prioritized while a latching operation of the first latch circuit is halted, a pulse signal is output again as the first latch signal for a period corresponding to a delay time of the delay circuit on completion of the access operation, and then the output of the first latch circuit is stored in the second latch circuit when the second latch signal is deactivated.

14. The semiconductor device for driving liquid crystals according to claim 9, wherein the controller includes a delay circuit, and controls the liquid crystal driver so that, when the CPU starts the access operation after a pulse signal has been output as the first latch signal for a period corresponding to a delay time of the delay circuit in response to activation of the second latch signal, while the second latch signal has still been activated, the access operation is performed whereas the first latch signal is not output again on completion of the access operation, and then the output of the first latch circuit is stored in the second latch circuit when the second latch signal is deactivated.

15. The semiconductor device for driving liquid crystals according to claim 9, wherein a pulse width for the CPU-access signal is narrower than a difference between a pulse width for the second latch signal and the delay time of the delay circuit.

16. The semiconductor device for driving liquid crystals according to claim 9, wherein the controller includes:

a first 3-input NOR gate and a second 3-input NOR gate each having three input terminals, each accepting an inverted signal of the second latch signal at one of the three input terminals and accepting the CPU-access signal at either of the remaining two input terminals;

a first R-S flip-flop having a set terminal and a reset terminal, that accepts an inverted signal of an output of the first 3-input NOR gate at the set terminal and an output of the second 3-input NOR gate at the reset terminal;

a delay circuit that delays an output of the first R-S flip-flop by a predetermined period;

a third 3-input NOR gate that accepts an output of the first R-S flip-flop, an inverted signal of an output of the delay circuit and the CPU-access signal; and a second R-S flip-flop having a set terminal and a reset terminal, that accepts an inverted signal of an output of the third 3-input NOR gate at the set terminal and the second latch signal at the reset terminal, and wherein the first 3-input NOR gate accepts the output of the second R-S flip-flop at the other of the remaining two input terminals, the second 3-input NOR gate accepts the output of the delay circuit at the other of the remaining two input terminals, and the first latch signal is output from an output terminal of the first R-S flip-flop.

17. A liquid crystal display apparatus having a semiconductor device for driving liquid crystals and a liquid crystal displaying section, the device comprising:

a single-port memory that stores display-data to be displayed on the liquid crystal displaying section;

a liquid crystal driver that retrieves the display-data stored in the single-port memory on a specific cycle and sends the display-data to the liquid crystal displaying section; and a controller that controls the liquid crystal driver so that, when a CPU does not have access to the single-port memory, the display-data is retrieved from the single-port memory to the liquid crystal driver on the specific cycle and the retrieved data is sent to the liquid crystal displaying section, whereas, when the CPU has access to the single-port memory while the data is being retrieved from the single-port memory to the liquid crystal driver, a priority is given to the CPU so that the CPU starts an access operation while the liquid crystal driver stops a display-data retrieval operation, and on completion of the access operation, the liquid crystal driver starts again the display-data retrieval operation, wherein the liquid crystal driver includes:

a first latch circuit that stores the display-data from the single-port memory in response to a first latch signal; and a second latch circuit that stores an output of the first latch circuit in response to a second latch signal, and wherein the controller outputs the first latch signal based on the second latch signal and a CPU-access signal that indicates the access operation of the CPU to the single-port memory.

18. A liquid crystal display apparatus having a semiconductor device for driving liquid crystals and a liquid crystal displaying section, the device comprising:

a single-port memory that stores display-data to be displayed on the liquid crystal displaying section;

a liquid crystal driver, a first latch circuit that stores the display-data from the single-port memory in response to a first latch signal and a second latch circuit that stores an output of the first latch circuit in response to a second latch signal, that retrieves the display-data from the single-port memory on a specific cycle and sends the display-data to the liquid crystal displaying section; and a controller that generates the first latch signal and sends the first latch signal to the first latch circuit, the first latch signal being generated based on a CPU-access signal indicating an access operation of a CPU to the single-port memory and the second latch signal that is synchronized with a display-data retrieval cycle for the liquid crystal driver.

* * * * *